United States Patent [19]

Agatahama

[11] 4,356,465

[45] Oct. 26, 1982

[54] ELECTRIC CONTACT SWITCHING DEVICE

[75] Inventor: Shunichi Agatahama, Osaka, Japan

[73] Assignee: Omron Tateisi Electronics, Co., Kyoto, Japan

[21] Appl. No.: 242,534

[22] Filed: Mar. 11, 1981

[30] Foreign Application Priority Data

| | | | |
|---|---|---|---|
| Mar. 15, 1980 | [JP] | Japan | 55/32879 |
| Feb. 14, 1981 | [JP] | Japan | 56/20365 |
| Feb. 16, 1981 | [JP] | Japan | 53/20967[U] |
| Feb. 16, 1981 | [JP] | Japan | 56/21671 |

[51] Int. Cl.[3] ..... H01H 67/02

[52] U.S. Cl. ..... 335/128; 29/622; 335/202

[58] Field of Search ..... 29/622; 200/1 A, 159 A, 200/283; 335/106, 128, 202, 203

[56] References Cited

U.S. PATENT DOCUMENTS

| | | | |
|---|---|---|---|
| 3,211,874 | 10/1965 | Bengtsson | 200/283 X |
| 3,987,383 | 10/1976 | Antonitsch | 335/78 |
| 4,260,971 | 4/1981 | Baumruck | 335/203 X |
| 4,292,613 | 9/1981 | Bando et al. | 335/202 X |

FOREIGN PATENT DOCUMENTS

| | | | |
|---|---|---|---|
| 2706464 | 8/1977 | Fed. Rep. of Germany | 29/622 |

*Primary Examiner*—William M. Shoop
*Attorney, Agent, or Firm*—Wegner & Bretschneider

[57] ABSTRACT

Electric contact switching device comprising a plurality of contact member pairs, each pair consisting of a first lead member having a first contact and a second lead member having a second contact which are disposed in mutually opposed relation, a first insert-molded base member having a compartment and carrying the first and second lead members so as to house the first and second contacts within the compartment thereof, a second insert-molded base member carrying the second lead members, and contact driving means for driving the first and/or second contacts to provide switching operations, said first and second base members being connected through the second lead members each other.

8 Claims, 8 Drawing Figures

ELECTRIC CONTACT SWITCHING DEVICE

BRIEF SUMMARY OF THE INVENTION

This invention relates to an electric contact switching device having a plurality of contact members, and more particularly to an improved switching device including an insert-molded base member carrying lead members having contacts.

It is well known that a miniature-size electric contact switching device, e.g. an electromagnetic relay, for installation on a printed circuit board, includes a plurality of switching contacts and is constructed in a stacked-up and flat-shaped construction. Such a conventional electric contact switching device, however, is made up of a fairly large number of parts, and involves many assembling steps for production. As a result, the conventional device is costly and does not lend itself to automatic mass production.

It is, therefore, a primary object of this invention to provide an electric contact switching device which consists of a fairly small number of parts and has a mechanically stout construction.

It is a further object of this invention to provide an electric contact switching device which is easy to assemble and can be produced in a simplified automatic mass production line and in high yield.

It is a still further object of this invention to provide an electric contact switching device structure which can be hermetically sealed by a simple and speedy sealing process.

Other objects and advantages of this invention will become apparent from the following detailed description and the accompanying drawings, in which:

DETAILED DESCRIPTION

Figure 1:
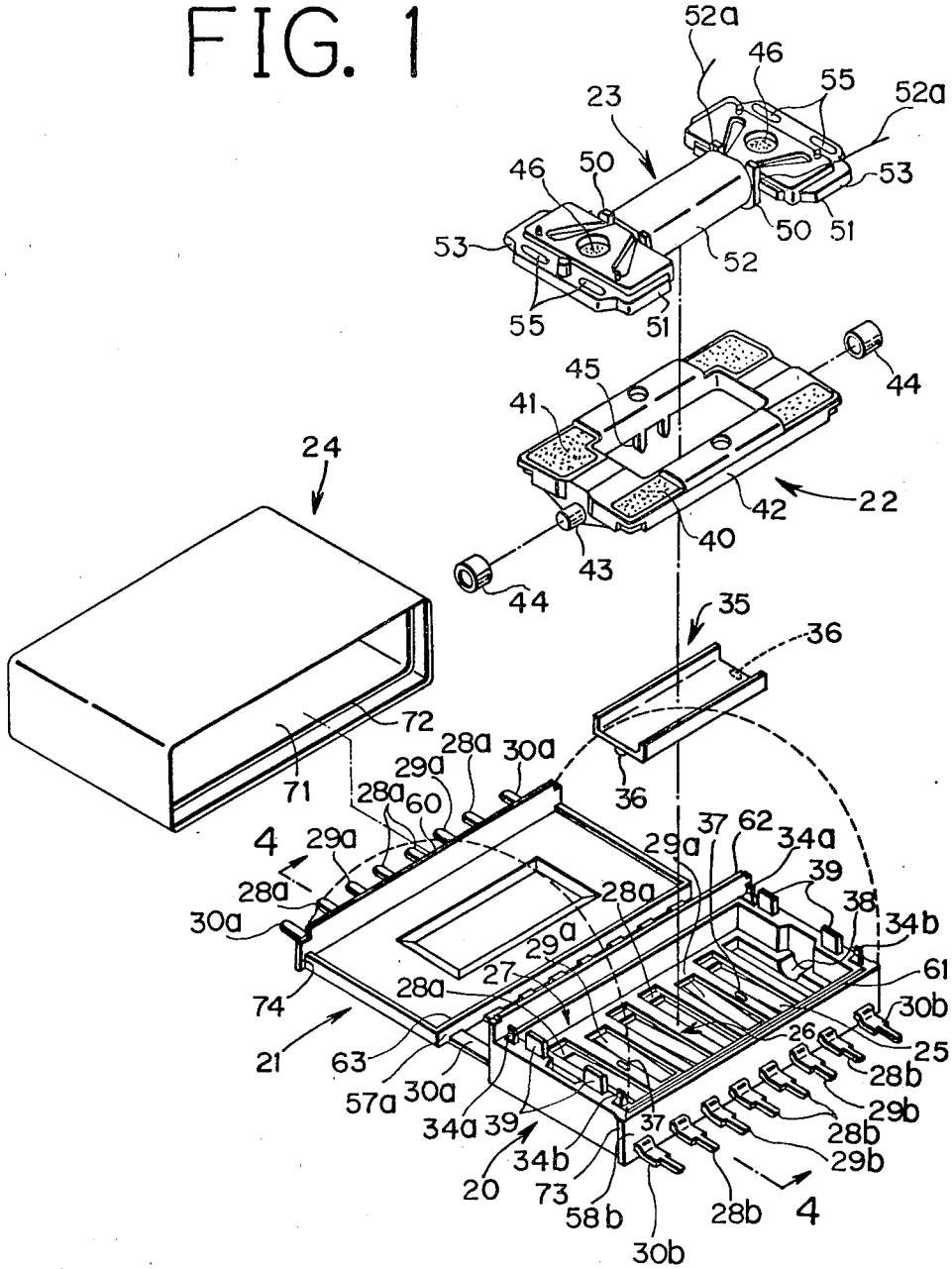
FIG. 1 is an exploded perspective view of an electromagnetic relay as a preferred embodiment of this invention.

Referring, now, to FIG. 1, there is shown a semi-assembled electromagnet relay as a preferred embodiment of this invention. The relay includes a first insert-molded base member 20 which carries first lead members **28*b*, 29*b* and 30*b* and second lead members 28*a*, 29*a* and 30*a*, a second insert-molded base member 21 which carries the second lead members 28*a*, 29*a* and 30*a*, an electromagnet member as a contact driving means which consists of an armature 22 and an electromagnet 23, and a cover 24**.

Figure 3:
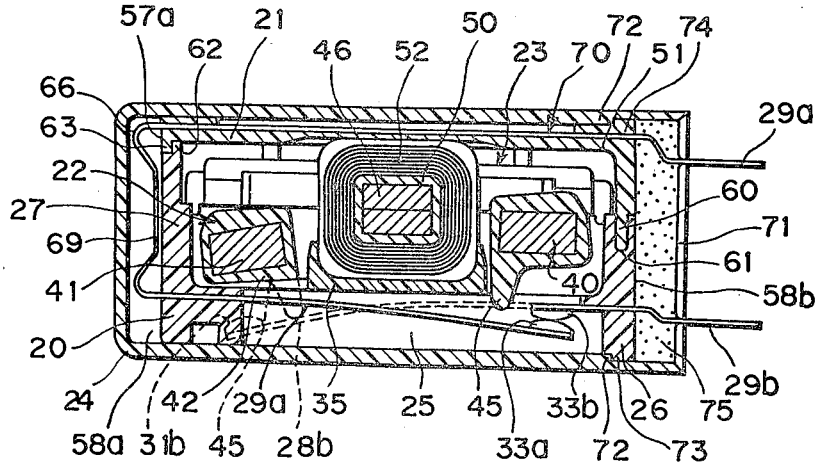
FIG. 3 is a front sectional view taken along the line 3—3 of FIG. 1.

The first insert-molded base member 20 is a single insulating molded plastic member which is generally shaped like a box and includes a bottom wall 26 which has a plurality of elongated opening or chambers 25 and a side wall 27 vertically extending from the periphery of the bottom wall 26. In the base member 20 there are inserted the first and second lead members **28*b* and 28*a* which are normally-open contact connecting leads, the first and second lead members 29*b* and 29*a* which are normally-closed contact connecting leads, and the first and second lead members 30*b* and 30*a* which are coil connecting leads arranged in parallel with each other. As ilustrated in FIG. 4, the normally-open contact connecting leads 28*a* and 28*b* are connected to stationary and movable contacts 31*a* and 31*b*, respectively. As illustrated in FIG. 3 which shows a completely assembled relay of FIG. 1, the normally-closed contact connecting leads 29*a* and 29*b* are connected to movable and stationary contacts 33*a* and 33*b***, respectively.

Figure 4:
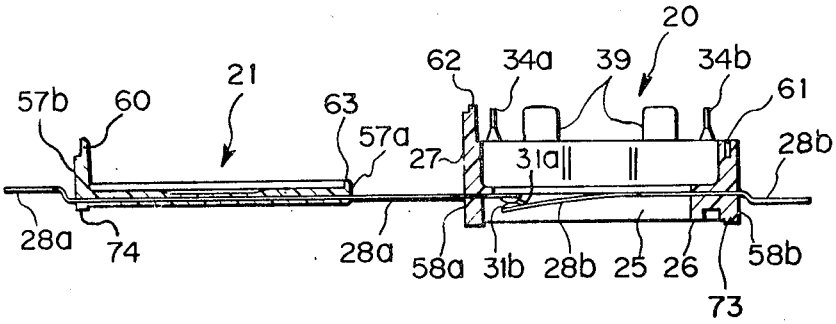
FIG. 4 is a front sectional view taken along the line 4—4 of the first and second base members of FIG. 1.

The first and second base members 20 and 21 which are illustrated in FIGS. 1 and 4 are produced as follows: An electrically conductive metal sheet is pressed to provide a lead frame including a plurality of confronting lead pairs **28*a*–28*b*, 29*a*–29*b* and 30*a*–30*b*, all of which are contiguous to the remainder thereof; The contacts 31*a*, 31*b*, 33*a*and 33*b* are respectively fixed to the respective confronting ends of the leads 28*a*, 28*b*, 29*a* and 29*b*; The lead frame at the remainder thereof is bent in such a manner that the confronting pairs of leads 28*a*–28*b* and 29*a*–29*b* are respectively brought into overlapping relationship; With the lead frome having the above-described contact mechanism, insulating bases 20 and 21 are molded by insert-molding; Finally, the remainder of the lead frame is cut off to provide a couple of independent contacts as illustrated in FIGS. 1 and 4**.

Thus, the leads **28*b* and 29*a* are movably disposed within the respective electrically isolated openings or chambers 25 so as to provide for open-and-close operations. The leads 28*b*, 29*b* and 30*b*, supported by the first base member 20, are extending outwardly of a side wall surface 58*b* of the side wall 27 as the respective external connecting terminals. The leads 28*a*, 29*a* and 30*a* are carried by the base member 20, extending outwardly of an opposite side wall surface 58*a* of the side wall 27, carried by the second insert-molded base member 21, and further extending outwardly of a side wall surface 57*b* of the base member 21 as the respective external connecting terminals. The respective inner ends 34*a* and 34*b*, viz. coil connectors, of the leads 30*a* and 30*b* are projecting upwardly of a top wall surface of the vertical wall 27**.

As illustrated in FIG. 1, an insulating member 35 is mounted on the bottom wall 26 in such a manner that a pair of downwardly extending projections 36 are fitted into a pair of holes 37 formed in the wall 26.

The armature 22 is an insert-molded element comprising a permanent magnet bar 40 and an iron yoke 41 embedded in parallel within a synthetic resin matrix 42, and carries a pair of drive stub shafts 43 and a plurality of downwardly extending projections 45 arranged in dual lines for depressing movable portions of the normally-open contact connecting leads **28*b* or the normally-closed contact connecting leads 29*a* when the electromagnet 23 is disenergized or energized. The armature 22, with journals 44 affixed to its shafts 43, is mounted on the base member 20 for rocking movement in such a manner that the journals 44 are accommodated in a pair of arcuate recesses 38 formed in the base wall 26** thereof.

The electromagnet 23 is an insert-molded element consisting of an I-shaped iron bar core 46 as embedded in a similarly shaped synthetic resin matrix 51, a central portion of the matrix 51 forming a spool 50 which supports a coil winding 52. The matrix 51 has a pair of flanges 53 around a peripheral portion thereof.

The electromagnet 23 is mounted on the base member 20 which accommodates the insulating member 35 and the armature 22 with journals 44. Four holes 55 formed in the flanges 53 are pierced by projections 39 extending upwardly of the vertical wall 27. The flanges 53 are fitted onto and supported by upper portions of the wall 27. Both ends of the matrix 51 at its intermediate portions have projections 56 (illustrated in FIGS. 2 and 7) downwardly extending therefrom so as to fix journals 44 to arcuate recesses 38 of the base member 20. The projections 39 are caulked by fusion to secure the electromagnet 23 rigidly to the base member 20. Wires 52*a* of the coil winding 52 are soldered to connectors 34*a* and 34*b*.

Then, the respective intermediate portions of the leads 28*a*, 29*a* and 30*a* between side wall surfaces 57*a* and 58*a* (see FIG. 4) are folded back so as to bring the second base member 21 over the chamber surrounded by the wall 27 of the first base member 20. The second base member 21 is secured to the first base member 20 in such a manner that a projection 60 formed on the second base member 21 is inserted into a groove 61 formed in the wall 27 of the first base member 20 and an edge 63 of the base member 21 is engaged with a stepped portion 62 formed in the base member 20 as illustrated in FIG. 3. Thus, the respective projecting ends of the second leads 28*a*, 29*a* and 30*a* are fixed in position against those of the first leads 28*b*, 29*b* and 30*b*.

Figure 5:
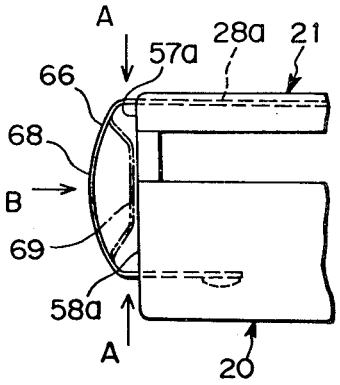
FIG. 5 is a schematic partial view illustrating the second lead member of FIG. 3 prior to a deforming operation.

As illustrated in FIG. 5, when the second base member 21 has been mounted on the first base 20, the respective leads 28*a*, 29*a* and 30*a* are curved as depicted in solid lines. In this condition, the forces built up at the bent portions 68 are applied to the first and second base members 20 and 21 so that when the ambient temperature is increased, the first and second base members are liable to be deformed. The bent portions 68 are also projecting from the side wall surface 58*a* a fairly great distance and not suitable for a miniturized configuration of this relay. Therefore, in this embodiment, the curved portions 68 are pressed in the direction indicated by arrow mark B, with restrictions applied to both sides thereof in directions shown by arrow marks A. Thus, the curved portions 68 are concavely deformed as shown in one-dot lines 69, so that the built-up forces of the bent portions 68 are annihilated and the volumetric dimensions are decreased.

Figure 2:
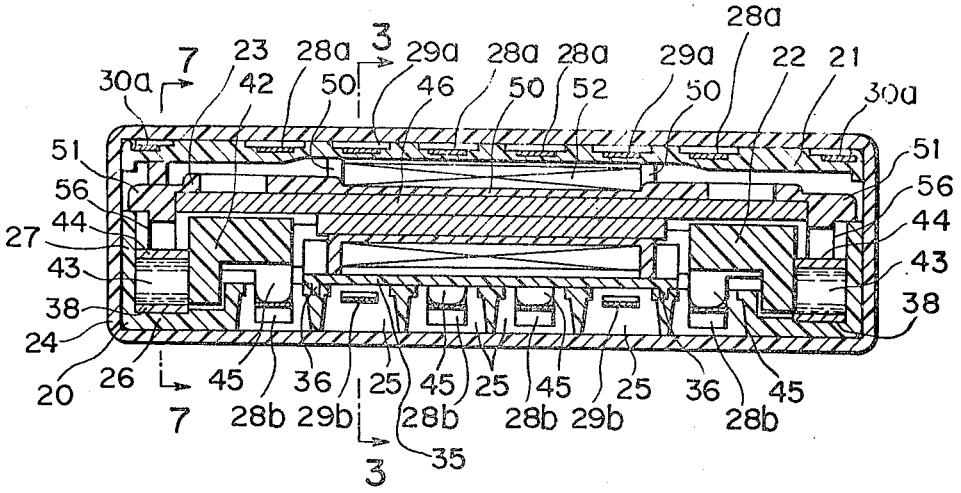
FIG. 2 is an assembled sectional side-elevation view showing the electromagnetic relay of FIG. 1.

Thus, a relay assembled body 70 is obtained which is shown in FIGS. 2 and 3 apart from the cover 24 and a sealant 75. Returning to FIG. 3, the relay body 70 is inserted into the cover 24 through an opening 71 from the right-hand side to the left-hand side until projections 73 and 74 of the base members 20 and 21 (see FIG. 4) are fitted to stepped portions 72 formed inside the case 24 (see FIG. 1). Then, the opening 71 of the cover 24 accommodating the relay body 70 is filled with sealant 75, e.g. epoxy resin, so that base members 20 and 21 at the surfaces 58*b* and 57*b* thereof, cover 24 and leads 29*a* (28*a*, 30*a*) and 29*b* (28*b*, 30*b*) may be secured together in position and sealed airtight. Thus, the complete relay of FIG. 3 or FIG. 2 is provided.

The electromagnetic relay thus completely constructed is normally such that the swigably disposed armature 22 is positioned as illustrated in FIG. 3, whereby the normally-closed contacts 33*a* and 33*b* are closed therebetween but the normally-open contacts 31*a* and 31*b* are opened because the leads 28*b* is downwardly depressed by the projections 45 arranged at the left-hand side in FIG. 3. When the coil 52 is energized, the electromagnet 23 drives the armature 22 so as to establish an electric connection between the normally-open contacts 31*a* and 31*b* and break the connection between the normally-closed contacts 33*a* and 33*b*. That is to say, the armature 22 rotates clockwise and the projections arranged at the left-hand side in FIG. 3 release the respective biased movable portions of the leads 28*b* and the projections 45 on the right-hand side depress the respective movable portions of the leads 29*a*. When the coil 52 is disenergized, the armature 22 moves counterclockwise and returns to its original status shown in FIG. 3.

Figure 6:
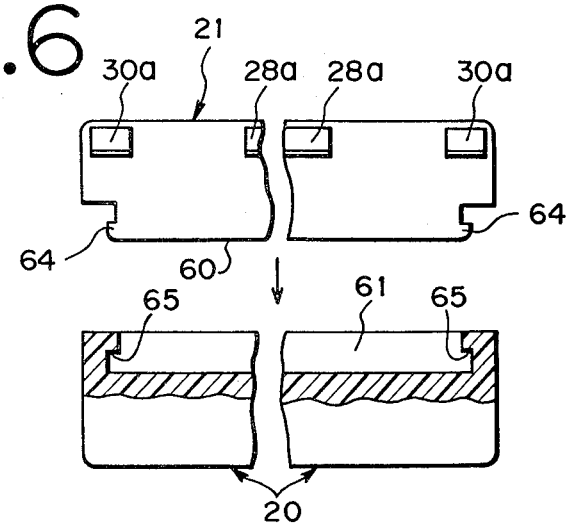
FIG. 6 is a schematic partial view illustrating the first and second base members as a modification of the embodiment of FIG. 1.

Since the first and second base members 20 and 21 can be secured together without using any jointing members, the number of parts and the number of assembling steps for production are decreased. The respective first and second base members 20 and 21 are supported at their peripheral portions by the cover 24, with the result that any external force applied to the cover 24 above the coil 52, for instance, will not be directly acting on the electromagnet 23. Thus, the relay of this embodiment has a mechanically durable construction. The engaging arrangement between the first and second base members 20 and 21 may be modified in such a manner that as illustrated in FIG. 6, the projection 60 of the second base member 21 has a pair of nails 64 projecting horizontally and the groove 61 further includes a pair of recessed portions 65 so as to fixedly joint the first and second base members 20 and 21 together. If desired, the cover 24 and the sealant 75 may be omitted from the relay of FIG. 3 or 2 as a simplified construction.

Figure 7:
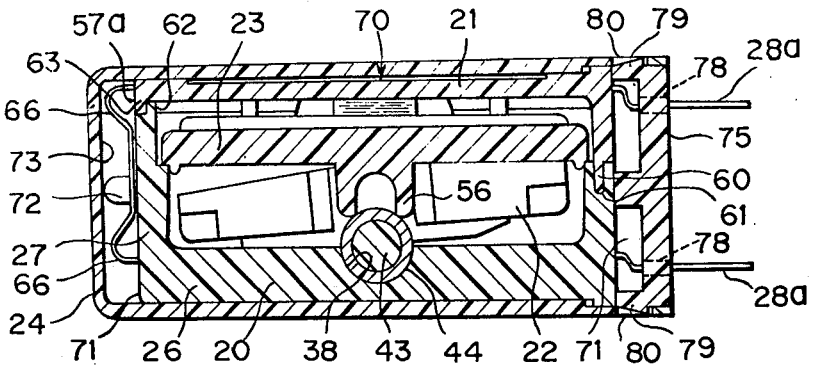
FIG. 7 is a front sectional view showing an electromagnetic relay as another modification of the embodiment of FIG. 1.

In FIG. 7, there is shown a modification of the embodiment of FIG. 3. A relay body 70 housed in cover 24 of FIG. 7 is substantially identical to that of FIG. 3 or FIG. 2, but the first base member 20 further includes a projection 72 extending from a wall surface 58*a* thereof. The projection 72 is disposed to secure a sufficient distance so that the bent portions 66 may not be contacted to an inner wall 73 of the cover 24 under any external forces applied thereto. The cover 24 is modified so as to include several holes 80 in a predetermined position. The relay of FIG. 7 further includes an insulating molded plate 75 which has projecting nails 79 for engagement with the holes 80 of the cover 24 and holes 78 pierced by leads 28*a*, 28*b*, 29*a*, 29*b*, 30*a* and 30*b*. The plate 25 is formed so as to be fitted into the opening 71 of the cover 24. The relay of FIG. 7 is assembled in such a manner that the relay body 70 with the plate 75 pierced by the leads 28 to 30 is inserted into the cover 24 until the projection 72 is blocked by the wall surface 73 and the nails 79 are allowed to fit into the holes 80.

Figure 8:
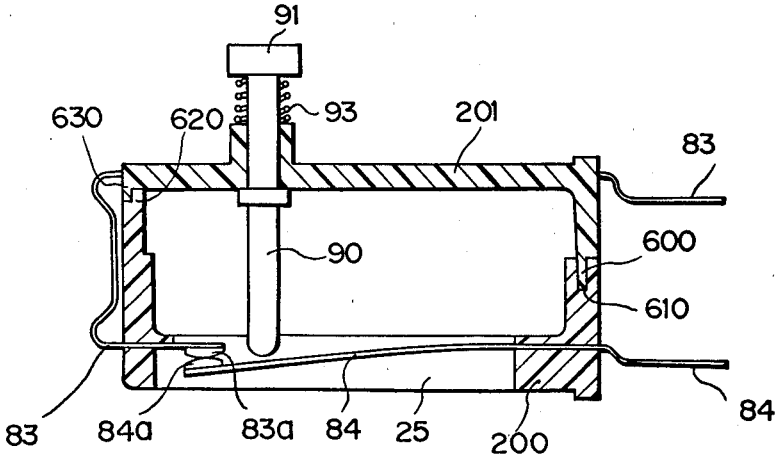
FIG. 8 is a schematic front sectional view showing a manual operation switching device as another embodiment of this invention.

Uses for the electric contact switching device in accordance with this invention are not restricted to the above-described relays. In FIG. 8 there is shown a manual operation switch as a further embodiment of this invention. The switch consists of a first base member 200 carrying a first lead 84 and a second lead 83, a second base member 201 carrying the second lead 83, an actuator 91 as a contact driving means which is normally biased upwardly by a coil spring 93 and slidably supported by the base member 201. The electrical connection between normally-closed contacts 83*a* and 84 is broken by the actuator 90 which is depressed downwardly by an external manual operation applied to a button 91. In this embodiment the second base member 201 is firmly secured to the first base member by the engagement between stepped portion 620 and edge 630 and the engagement between projection 600 and groove 610 in the same manner as that of the above embodiments. Though the switch of FIG. 8 is shown as including a pair of leads 83 and 84, it may be modified to include a plurality of lead pairs of the above embodiments.

In the foregoing embodiments, the respective leads carrying movable contacts are made of jointless leads, but may be modified in such a manner that they consist of terminal portions embedded in the first base member and resilient movable blades jointed to the respective terminal portions by spot-solding.

It should be understood that the above description is merely illustrative of this invention and that many changes and modifications may be made by those skilled in the art without departing from the scope of the appended claims.

What is claimed is:

1. Electric contact switching device comprising:

a plurality of contact member pairs arranged in parallel with each other, each pair consisting of a first lead member having a first contact and a second lead member having a second contact, said first and second contacts being disposed in mutually opposed relation;

a first insert-molded base member having a compartment and carrying said second lead members at their portions adjacent to said second contacts and said first lead member so as to support said first and second contacts within said compartment;

a second insert-molded base member carrying said second lead members away from said first base member; and contact driving means for driving said first and/or second contacts to provide close-and-open switching operations;

the respective intermediate portions of said second lead members between said first and second base members being bent so as to allow said second base member to be mounted on said first base member, and said first and second lead members extending outwardly of the respective first and second base members.

2. Electric contact switching device according to claim 1, wherein said first and second base members are respectively provided with engaging portions so that said first and second base members may be secured to each other as they are jointed together.

3. Electric contact switching device according to claim 1, wherein said bent intermediate portions of the second lead members are concavely deformed after mounting of said member so as to annihilate a force biasing said first and second base members through said bent intermediate portions.

4. Electric contract switching device according to claim 1, which further comprises a cover means which is provided with an opening and in which said first and second base members to be jointed together are housed and supported thereby, and said first and second lead members extending outwardly of said first and second base members are projecting outwardly of said cover through said opening.

5. Electric contact switching device according to claim 4, wherein said opening is filled with a sealant so as to secure said case, first and second lead members, and first and second base members as a unit.

6. Electric contact switching device according to claim 4 further comprising an insulating plate member which is pierced by said first and second lead members and is fitted into said opening so as to secure said first and second base members against said cover.

7. Electric contact switching device according to claim 1 wherein said contact driving means is an electromagnet member which is accommodated in said compartment.

8. Electric contact switching device according to claim 1, wherein said contact driving means is a manual operation actuator which is slidably supported in said second base member.

* * * * *